United States Patent [19]

Stuhlmacher

[11] Patent Number: 5,008,503

[45] Date of Patent: Apr. 16, 1991

[54] SWITCH WITH COLORED INDICATOR CAP

[75] Inventor: John A. Stuhlmacher, Crown Point, Ind.

[73] Assignee: McGill Manufacturing Company, Inc., Valparaiso, Ind.

[21] Appl. No.: 427,737

[22] Filed: Oct. 27, 1989

[51] Int. Cl.[5] ..... H01H 9/18; H01H 23/14

[52] U.S. Cl. ..... 200/308; 200/339; 200/309

[58] Field of Search ..... 200/308, 309, 310, 312, 200/315, 339, 302.3, 553, 311

[56] References Cited

U.S. PATENT DOCUMENTS

| | | | |
|---|---|---|---|
| Re. 30,546 | 3/1981 | Piber | 200/308 |
| 3,250,887 | 5/1966 | Sorenson | 200/308 |
| 3,408,463 | 10/1968 | Wanlass | 200/339 X |
| 3,538,285 | 11/1970 | Orts | 200/308 |
| 3,598,950 | 8/1971 | Ohashi | 200/315 |
| 3,996,441 | 12/1976 | Ohashi | 200/309 |
| 4,340,791 | 7/1982 | Sorenson | 200/315 X |

FOREIGN PATENT DOCUMENTS

| | | | |
|---|---|---|---|
| 0280604 | 8/1988 | European Pat. Off. | 200/308 |
| 1185463 | 3/1970 | United Kingdom | 200/308 |
| 1336723 | 11/1973 | United Kingdom | 200/315 |
| 1485770 | 9/1977 | United Kingdom | 200/315 |

*Primary Examiner*—Ernest G. Cusick

*Attorney, Agent, or Firm*—Leydig, Voit & Mayer

[57] ABSTRACT

An electrical switch includes a rocker-type actuator molded of plastic and adapted to be pivoted between first and second positions within a housing in order to close and open switch contacts. The actuator includes an enlarged molded head and a separately molded indicator cap which is of a different color from the head and which is adapted to be snapped onto the head.

11 Claims, 2 Drawing Sheets

SWITCH WITH COLORED INDICATOR CAP

BACKGROUND OF THE INVENTION

This invention relates to an electrical switch and, more particularly, to a switch whose contacts are opened and closed in response to pivoting of a rocker-type actuator which usually is molded from plastic.

In a switch of this type, it is often desirable that two different portions of the actuator be of two different colors (e.g. black and red or black and green) so that the more pronounced color is highly visible when the actuator is in a given position. While a two-tone actuator may be produced either by selective painting of the actuator or more commonly by molding two different portions of the actuator from two different colors of plastic, these methods are relatively expensive and require special equipment.

SUMMARY OF THE INVENTION

The general aim of the present invention is to provide a new and improved rocker-type switch whose actuator may be made multi-colored in a simpler and less expensive manner than has been possible heretofore.

A more detailed object of the invention is to achieve the foregoing by providing a separately molded colored cap adapted to be assembled with the actuator with a snap-on fit. By using a separate cap of different color from the actuator, the actuator may be made to have a two-tone appearance without need of using special molding techniques requiring special molding equipment.

The invention also resides in the unique interfitting relation of the actuator and the cap to retain the cap securely on the actuator and to cause the actuator to have a streamlined appearance in spite of the presence of the cap.

These and other objects and advantages of the invention will become more apparent from the following detailed description when taken in conjunction with the accompanying drawings.

DETAILED DESCRIPTION OF THE PREFERRED EMBODIMENT

Figure 1:
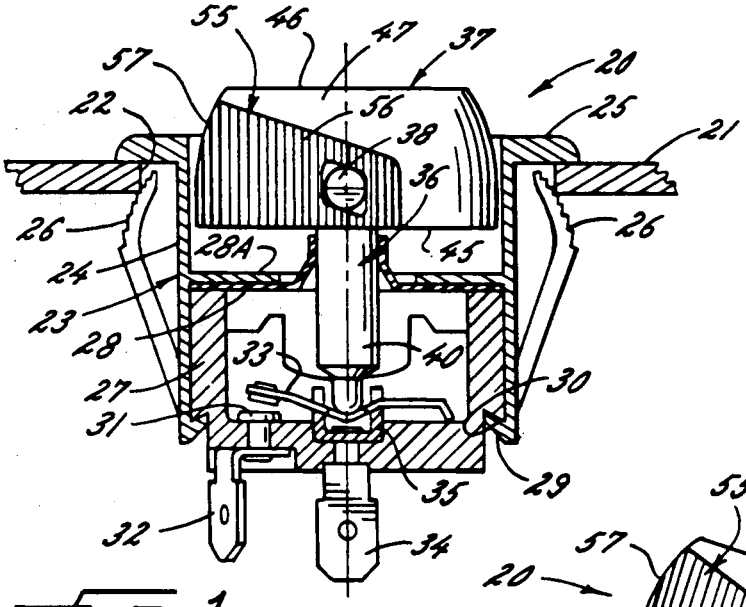
FIG. 1 is a side elevational view of a new and improved switch embodying the unique features of the present invention, certain portions of the switch being broken away and shown in section.

For purposes of illustration, the present invention has been shown in the drawings as being incorporated in an electrical switch 20 for making or breaking a circuit to an electrical utilization device (not shown). The switch has been illustrated in conjunction with a mounting plate 21 which is formed with a rectangular hole 22 for receiving the switch. The switch includes a main body or housing 23 which is partially defined by a molded plastic sleeve 24 of rectangular exterior cross-section telescoped into the opening 22 and formed with a peripheral flange 25 which engages the upper side of the plate around the margins of the opening. Cantilevered fingers 26 are molded integrally with and are hinged to the sleeve and are adapted to pass through the opening 22 during insertion of the sleeve into the opening. Just after such insertion, the fingers 26 spring outwardly and engage the lower portion of the edge of the opening 22 so as to hold the sleeve 24 in the opening.

The housing 23 also includes an upwardly opening cup 27 made of plastic and adapted to be telescoped into the lower end portion of the sleeve 24. The upper edge of the cup engages a rubber diaphragm 28 which is backed by a radially inwardly projecting flange 28A formed integrally with the sleeve about midway along the height of the sleeve. An annular rib 29 on the lower end portion of the sleeve 24 snaps into an annular groove 30 in the lower end portion of the cup 27 in order to hold the sleeve and the cup in assembled relation.

Located in the bottom of the cup 24 is a switch contact 31 connected to a terminal 32. Overlying the contact 31 is an elongated contact 33 connected to a terminal 34 and supported to rock about an electrically conductive fulcrum 35 which forms part of the terminal 34. When the contact 33 is positioned as shown in FIG. 1, it is spaced above the underlying contact 31 and thus the switch 20 is open. Counterclockwise pivoting of the contact 33 about the fulcrum 35 brings the contact 33 into engagement with the contact 31 as shown in FIG. 2 in order to close the switch.

Figure 2:
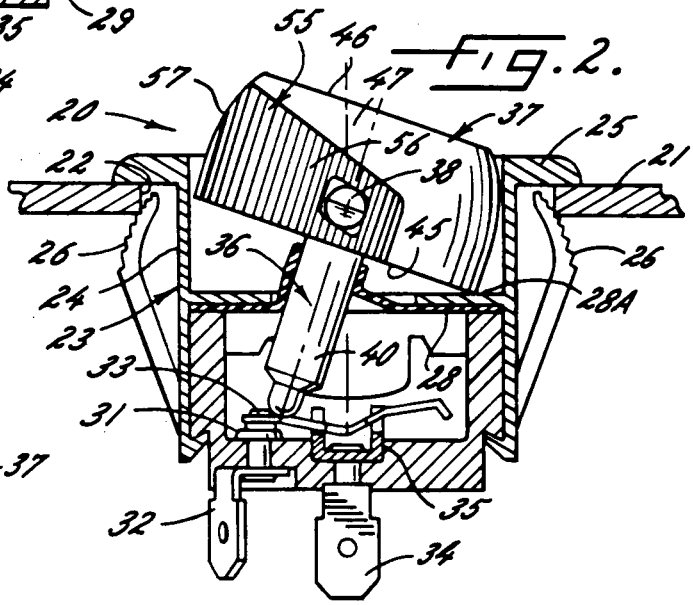
FIG. 2 is a view similar to FIG. 1 but shows the switch actuator in a moved position.
Figure 3:
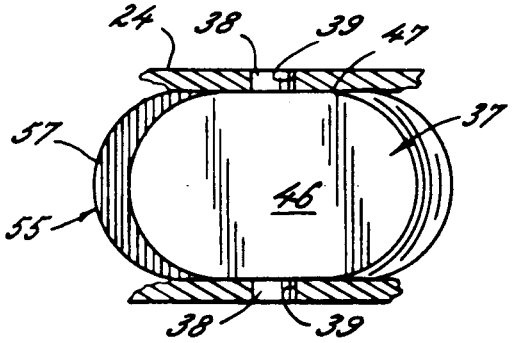
FIG. 3 is a fragmentary top plan view of the switch with certain parts of the switch housing broken away and shown in section.
Figure 4:
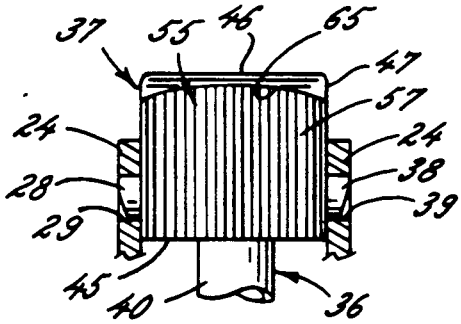
FIG. 4 is a fragmentary end view of the switch with certain parts of the switch housing broken away and shown in section.

Pivoting of the contact 33 is effected by a rocker-type actuator 36 which is supported by the sleeve 24 of the housing 23 to pivot between first and second positions (FIGS. 1 and 2). Herein, the actuator 36 is molded of plastic and includes an enlarged head 37 which is formed with two oppositely extending trunnions 38 that project through circular holes 39 (FIG. 3) in the sleeve 24 to support the actuator for pivoting about a horizontal axis. The head is molded integrally with an elongated and generally vertical stem 40 whose lower end is engageable with the contact 33. When the actuator 36 is positioned as shown in FIG. 1, the stem holds the contact 33 out of engagement with the contact 31. When the actuator 36 is pivoted clockwise about the axis of the trunnions 38 from the position shown in FIG. 1 to the position shown in FIG. 2, the stem 40 rides from right-to-left along the contact 33 and bears downwardly against the left end portion of the contact 33 so as to press that contact downwardly against the contact 31 and thereby close the switch 20.

Figure 7:
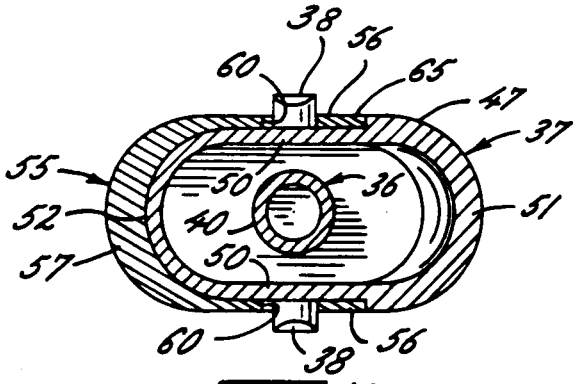
FIG. 7 is a cross-section taken substantially along the line 7—7 of FIG. 6.

The head 37 of the actuator 36 includes a flat and planar bottom edge surface 45, a parallel top wall surface 46, and a peripheral side wall 47 which extends between the bottom and top surfaces. The head 37 is oblong in shape and has generally the same configuration as a racetrack when viewed from above. Thus, the side wall 47 includes two straight and parallel straight sections 50 (FIG. 7) and two convexly curved end sections 51 and 52 located at the ends of the straight sections. The two ends 51 and 52 curve inwardly toward one another as they progress upwardly toward the top surface 46. The interior of the sleeve 24 has substantially the same oblong configuration as the head.

In many installations, it is desirable that one of the end portions of the head 37 of the actuator 36 be of a different color from the remainder of the head. If, for example, the left end portion of the head is red, the red color visually highlights the position of the actuator when the actuator is located as shown in FIG. 2 with the switch 20 in its actuated or closed state.

In accordance with the present invention, the actuator 36 includes a colored indicator cap 55 preferably molded of plastic and adapted to be attached to the head 37 with a snap-on fit. By molding the head 37 and the cap 55 separately and from plastics of different colors, the actuator 36 may be made multicolored without need of using special and relatively expensive molding equipment capable of injecting plastic of two different colors into a single mold.

More specifically, the indicator cap 55 is molded of a resiliently yieldable material such as nylon and, in the present instance, is molded of red material. Thus, in the drawings, the cap has been lined for the color red. The head 37 and the integral stem 40 typically are molded of black plastic.

Figure 5:
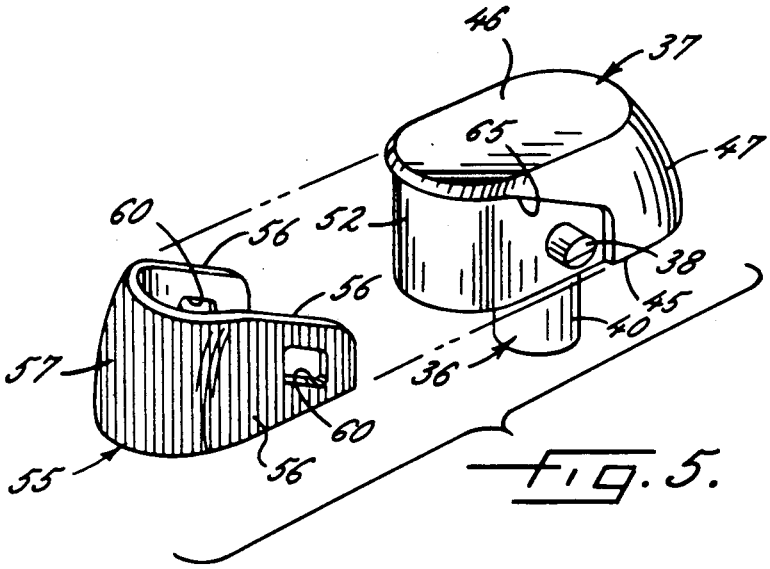
FIG. 5 is an exploded perspective view of the actuator and the snap-on cap.
Figure 6:
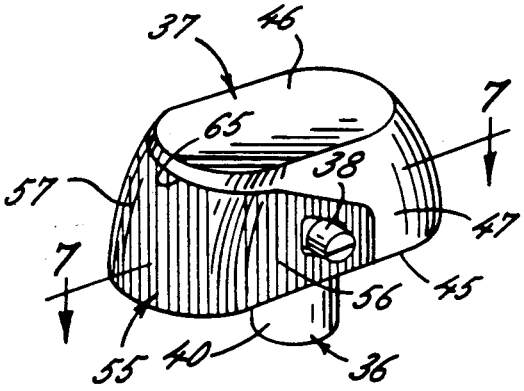
FIG. 6 is a perspective view showing the cap assembled with the actuator.

As shown most clearly in FIG. 5, the indicator cap 55 is generally U-shaped and includes two transversely spaced legs 56 interconnected by a curved bridge 57. The lower edges of the legs and the lower edge of the bridge are disposed in a common plane which is horizontal when the actuator 36 is positioned as shown in FIG. 1. The upper edges of the legs are disposed in an inclined plane which converges toward the first-mentioned plane upon progressing toward the free ends of the legs.

A generally rectangular and transversely extending hole 60 (FIG. 5) is formed through each leg 56 near the free end thereof. As will become more apparent subsequently, the holes 60 are adapted to receive the trunnions 38 of the head 37 when the cap 55 is assembled with the head.

In keeping with the invention, the head 37 is shaped in such a manner as to receive the indicator cap 55 without it being readily noticeable that the indicator cap is a separate member. For this purpose, a relief 65 (FIG. 5) is formed in the side wall 47 of the head 37 and its shape coincides with the shape of the inside surface of the cap 55. The relief extends beyond the trunnions 38 and extends to the lower edge surface 45 of the head 37 but terminates short of the upper surface 46 of the head. When the cap 55 is in its assembled position on the head 37, its legs 56 lie flush with the side wall 47 while its upper edges are concealed within the relief 65. Thus, the cap appears substantially as a smooth continuation of the side wall 47 except for the difference in color.

Assembly of the cap 55 with the head 37 is effected merely by spreading the legs 56 of the cap to allow the holes 60 to receive the trunnions 38. When the legs are released, the resilient memory of the plastic springs the legs together against the surface of the relief 65. The edges of the relief prevent the cap from pivoting in either direction about the trunnions 38 while the edges of the holes 60 prevent the cap from shifting outwardly from the head. When the actuator 36 is installed in the housing 23, the sides of the sleeve 24 captivate the legs 56 of the cap 55 against the relief 65 and restrict outward spreading of the legs.

From the foregoing, it will be apparent that the present invention brings to the art a switch 20 with a new and improved indicator cap 55 which may be snapped onto the actuator head 37 in a quick and easy manner. The separately formed cap allows the head to be molded of plastic of a single color and yet still enables the actuator 36 to have a two-tone appearance. By using caps of different colors, the visual effect of the switch may be customized as desired and, in addition, switches of a like nature but used for different purposes in a single installation may be readily distinguished from one another.

I claim:

1. A switch actuator comprising an enlarged manually engageable head having a first surface, having an oppositely facing second surface and having a peripheral side surface extending between said first and second surfaces around the margins thereof, oppositely extending trunnions projecting transversely from said side surface, and an indicator cap made of resilient material and having trunnion receiving holes for positive snap action attachment to said trunnions for retaining said cap on said head, and said indicator cap and said side wall being of different colors whereby the cap visually highlights a portion of the actuator.

2. A switch actuator as defined in claim 1 in which a recessed relief is formed in said side surface, said indicator cap being received in said relief.

3. A switch actuator as defined in claim 2 in which said head is generally oblong, said side surface having two substantially straight side sections and having two curved end sections, said relief being formed in one of said end sections and in portions of said side sections and terminating short of the other of said end sections.

4. A switch actuator as defined in claim 3 in which said relief includes a surface which is recessed inwardly from said peripheral side surface, said cap being generally U-shaped and having two substantially straight legs integrally interconnected by a curved bridge, said cap being positioned with said bridge extending along said one end section and with said legs extending along said portions of said straight sections.

5. A switch actuator as defined in claim 4 in which said relief extends to said first surface and terminates short of said second surface, said cap having an outer surface substantially flush with the peripheral side surface of said head.

6. A switch actuator ad defined in claim 4 in which resiliently yieldable material of said cap enables said legs to be spread to permit insertion of said trunnions into said holes.

7. An indicator cap adapted to be attached to a switch actuator having a pair of trunnions extending outwardly from opposed sides thereof, said cap comprising a single generally "U"-shaped piece having two substantially straight and transversely spaced legs interconnected by a curved bridge, said legs each being formed with a mounting hole near an end thereof, and said cap being made of resiliently yieldable material for enabling said legs to be spread outwardly relative to each other for receiving said trunnions in said holes with a positive snap action engagement.

8. A cap as defined in claim 7 in which said bridge and said legs include lower edges located in a predetermined plane, the free end portions of said legs including upper edges disposed in a plane which is inclined relative to said predetermined plane and which converges toward said predetermined plane upon progressing toward the free ends of said legs.

9. A switch comprising a housing having a switch contact, a switch actuator having a pair of side surfaces, opposed ends, and a top surface, said actuator having trunnions projecting outwardly from said side surfaces for supporting the actuator for pivotable movement relative to said housing between first and second positions to change the electrical state of said switch contact, a generally "U"-shaped indicator cap positionable about one end of said actuator and having transversely spaced legs for straddling said side surfaces, said legs being formed with holes which receive said trunnions for retaining said cap on said actuator, and said indicator cap and said actuator being of different colors whereby said cap visually highlights a portion of said actuator and provides a highlighted visual indication of the position of the actuator.

10. A switch as defined in claim 9 in which said actuator is formed with a recessed relieve in said one end and said side surfaces within which said indicator cap is positioned.

11. A switch as defined in claim 9 in which said cap is made of resiliently yieldable material for enabling said legs to be spread outwardly relative to each other for receiving said trunnions for positive snap action engagement with said trunnions.

* * * * *